United States Patent [19]

Tanaka et al.

[11] 4,373,880

[45] Feb. 15, 1983

[54] THROUGH-VANE TYPE ROTARY COMPRESSOR WITH CYLINDER CHAMBER OF IMPROVED SHAPE

[75] Inventors: Taro Tanaka, Nagoya; Hideaki Sasaya; Mitsuo Inagaki, both of Okazaki, all of Japan

[73] Assignee: Nippon Soken, Inc., Nishio, Japan

[21] Appl. No.: 260,210

[22] Filed: May 4, 1981

[51] Int. Cl.[3] ..... F04C 18/00

[52] U.S. Cl. ..... 418/150; 418/255

[58] Field of Search ..... 418/150, 255

[56] References Cited

U.S. PATENT DOCUMENTS

| | | | |
|---|---|---|---|
| 2,165,963 | 7/1939 | Curtis | 418/150 |
| 2,347,944 | 5/1944 | Fowler | 418/150 |
| 2,352,941 | 7/1944 | Curtis | 418/150 |
| 2,491,351 | 12/1949 | Zeitlin | 418/150 |
| 2,731,919 | 1/1956 | Prendergast | 418/150 |

FOREIGN PATENT DOCUMENTS

| | | | |
|---|---|---|---|
| 2407293 | 8/1974 | Fed. Rep. of Germany | 418/150 |

*Primary Examiner*—John J. Vrablik

*Attorney, Agent, or Firm*—Cushman, Darby & Cushman

[57] ABSTRACT

A through-vane type rotary compressor having a cylinder chamber of novel shape wherein a segment of the peripheral edge of the cylinder chamber connecting two circularly arcuate segments together has a shape represented by the formula $$R_2(\theta) = \frac{L}{2} + \frac{R' - R}{\theta_o}\left(\theta + \frac{\theta_o}{2\pi}\sin\frac{2\pi\theta}{\theta_o}\right),$$

and the slider has opposite ends each maintained in sliding contact with the peripheral edge at its arcuate end. The slider smoothly rotates along the peripheral edge of the cylinder chamber without impinging thereon while the acceleration of the sliding movement of the slider shows smooth changes.

3 Claims, 7 Drawing Figures

THROUGH-VANE TYPE ROTARY COMPRESSOR WITH CYLINDER CHAMBER OF IMPROVED SHAPE

BACKGROUND OF THE INVENTION

This invention relates to through-vane type rotary compressors, and more particularly it is concerned with a through-vane type rotary compressor having a cylinder chamber of improved shape.

Rotary compressors used for compressing a refrigerant for an air conditioning system for motor vehicles, for example, usually have a cylinder chamber which is of a cylindrical shape and provided with a fluid inlet port and a fluid outlet port opening therein. The cylinder chamber has mounted therein a cylindrical rotor disposed eccentrically with respect to the cylinder chamber and driven by a drive force for rotation, and a slider slidably extending through the center of rotation of the rotor and having opposite ends maintained in sliding contact with the wall of the cylinder chamber at all times. With this construction, the rotary compressor of the prior art has had disadvantages in that difficulties are experienced in providing a good seal between the inlet port and the outlet port and that uneven wear is caused on the opposite ends of the slider.

SUMMARY OF THE INVENTION

This invention has been developed for the purpose of obviating the aforesaid disadvantages of the prior art. Accordingly, the invention has as its object the provision of a through-vane type rotary compressor having a cylinder chamber of improved shape enabling a good seal to be provided and permitting the compressor to operate with minimized noise production, so that the compressor can operate with increased efficiency.

In the through-vane type compressor having a cylinder chamber of improved shape according to the invention, the peripheral edge of the cylindrical chamber is of the same arcuate shape as the outer periphery of the rotor for a circumferential extent of a predetermined angle between the inlet port and the outlet port to permit the rotor to come into surface-to-surface contact with the wall of the cylinder chamber and to enable a good seal to be provided between the inlet port and the outlet port. Thus the compressor is capable of performing compression of a fluid with a high degree of efficiency by avoiding leakage of the fluid. In the through-vane type rotary compressor according to the invention, the slider has its opposite ends shaped in an arcuate form to avoid only a specific portion of the opposite ends of the slider coming into sliding contact with the wall of the cylinder chamber to thereby prevent uneven wear from being caused on the opposite ends of the slider. This is conductive to increased stability of operation and prolonged service life of the compressor.

According to the invention, a segment of the peripheral edge of the cylinder chamber connecting two arcuate portions together has a shape which is represented by the following formula:

$$R_2(\theta) = \frac{L}{2} + \frac{R' - R}{\theta_o}\left(\theta + \frac{\theta_o}{2\pi}\sin\frac{2\pi\theta}{\theta_o}\right).$$

With this shape, the cylinder chamber according to the invention enables variations in the acceleration applied to the slider during operation of the compressor to take place smoothly, so that the slider can be kept in sliding contact with the wall of the cylinder chamber in good condition at all times without impinging on the peripheral edge of the cylinder chamber. This is conductive to prevention of noise production during operation of the compressor and increased service life thereof.

DESCRIPTION OF THE PREFERRED EMBODIMENT

This invention will be described by referring to an embodiment shown in the accompanying drawings.

Figure 1:
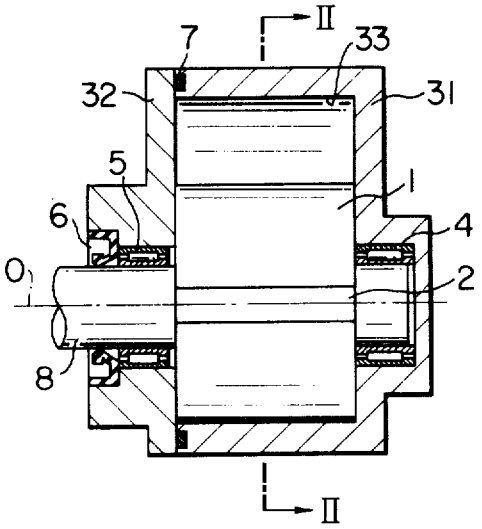
FIG. 1 is a sectional view of the through-vane type rotary compressor comprising one embodiment of the invention.
Figure 2:
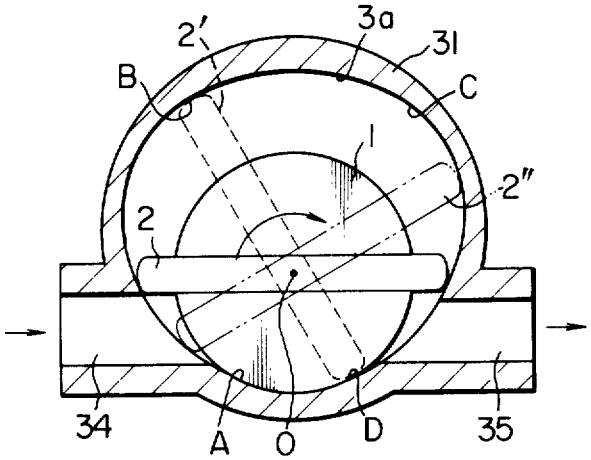
FIG. 2 is a sectional view taken along the line II—II in FIG. 1.

Referring to FIGS. 1 and 2, a rotor 1 of the cylindrical shape supporting a slider 2 extending through the center of rotation of the rotor 1 for sliding movement. The rotor 1 is connected to a drive shaft 8 for rotation therewith as a unit. Housing members 31 and 32 provide a housing for the rotor 1 and define a cylinder chamber 33 in the housing. The housing member 31 is formed therein with a refrigerant inlet port 34 for introducing from an evaporator, not shown, a refrigerant therethrough into the cylinder chamber 33 and a refrigerant outlet port 35 for discharging the refrigerant in the cylinder chamber 33 therethrough to a condenser, not shown. The housing members 31 and 32 are bolted together, for example, with an O-ring 7 being interposed therebetween, to provide the housing. The O-ring 7 may be replaced by a gasket or any other suitable seal member. The drive shaft 8 is rotatably journaled by bearings 4 and 5 mounted in the housing members 31 and 32 respectively, and a shaft sealing device is mounted at the open end of the housing member 32 to prevent the refrigerant in the cylinder chamber 33 from leaking along the drive shaft 8 to outside.

In the compressor of the aforesaid construction, the drive shaft 8 rotates the rotor 1 in the cylinder chamber 33 as a drive force is transmitted from an engine, not shown, of an automotive vehicle. As the rotor 1 rotates, the slider 2 also rotates in the cylinder chamber 33 while moving in sliding movement in the rotor 1 as indicated at 2' and 2'' in broken lines, so that a plurality of spaces defined by the wall surfaces of the cylinder chamber 33, the outer periphery of the rotor 1 and the slider 2 undergo changes in volume. Thus a refrigerant is drawn by suction through the inlet port 34 into the spaces in the cylinder chamber 33 and discharged through the outlet port 35 after being compressed. It is to be understood that the compressor according to the invention can handle any other fluid than the refrigerant.

Figure 3:
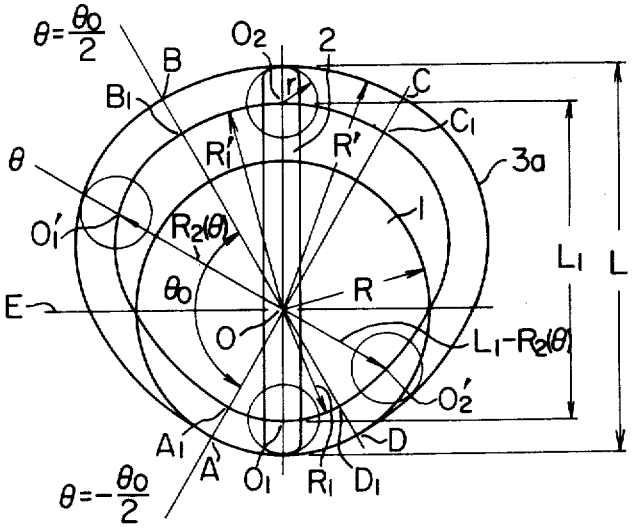
FIG. 3 is a schematic view in explanation of the shape of the peripheral edge of the cylinder chamber of the compressor shown in FIG. 1.

The cylinder chamber 33 of the compressor according to the invention has a peripheral edge 3a of a novel shape. The shape of the peripheral edge 3a will be described in detail by referring to FIG. 3. Let the radius of the rotor 1, the radius of the arcuate portions of the opposite ends of the slider 2 extending through the center O of the rotor 1 and the centers of the arcuate portions of the slider 2 be denoted by R, r and $O_1$ and $O_2$ respectively. With the length of the slider 2 being denoted by L, the distance $L_1$ between $O_1$ and $O_2$ is $L_1=L_1-2r$.

The peripheral edge 3a of the cylinder chamber 33 has a first segment DA which is in the form of a circular arc centered at the center of rotation O of the rotor 1 and has a radius R with the center angle of 20°-50°, so that the first segment DA is of the same circularly arcuate form as the rotor 1 and brought into surface-to-surface contact with the rotor 1 as the latter rotates. Thus the center $O_1$ of the arcuate portion of one opposite end of the slider 2 traces a locus $D_1A_1$ which is in the form of a circular arc of a radius $R_1$ ($R_1=R-r$) centered at the center of rotation O.

The peripheral edge 3a of the cylinder chamber 33 also has a second segment BC disposed between points B and C located opposite points D and A respectively with respect to the center of rotation O. The second segment BC is in the form of a circular arc of a radius R' ($R'=L-R$) in view of the need to keep the two opposite ends of the slider 2 in contact with the peripheral edge 3a of the cylinder chamber 33 at all times. Thus the center $O_2$ of the arcuate portion of the other opposite end of the slider 2 traces a locus $B_1C_1$ which is in the form of a circular arc of a radius $R_1'$ ($R_1'=L_1-R_1=L-R-r$).

The peripheral edge 3a of the cylinder chamber 33 has a third segment AB interposed between the first segment RA and the second segment BC. It is important what shape the third segment AB has. Compressors of the prior art generally have the segment AB of an arbitrarily selected curved shape, as described in Japanese Patent Application Laid-Open Number 23904/72, for example. With the third section AB of this shape, the peripheral edge 3a of the cylinder chamber 33 becomes irregular in form, so that it is impossible to expect the slider 2 to smoothly rotate. Thus the need to provide the third segment AB of a suitable shape to connect the first segment AD and the second segment BC together smoothly without any irregularities has been acutely felt. Various proposals have hitherto been made to provide an improved shape for the third segment AB.

In one proposal, the peripheral edge 3a of the cylinder chamber 33 is constructed such that the distance between the peripheral edge 3a and the center O of the rotor 1 increases and decreases in sine-wave form. In this case, the center $O_1'$ of the arcuate portion of one end of the slider 2 traces a locus $A_1B_1$ which is a curve of the form represented by the following formula in the range $-\theta_o/2 \leqq \theta \leqq \theta_o/2$ and with $\angle A_1OB_1=\theta_o$ and the angle $\theta$ of a straight line E dividing $\angle A_1OB_1$ into two equal parts being $\theta=O$:

$$R_1(\theta) = \frac{L_1}{2} + \frac{R'_1 - R_1}{2} \sin \frac{\pi\theta}{\theta_o}.$$

An external envelope formed by a family of circles of the radius r of the arcuate portion of the other end of the slider 2 having its center $O_2'$ on the aforesaid curve is used as a curve for the third segment AB. The segment CD may be in the same form as the segment AB and arranged symmetrically with the segment AB with respect to the center of rotation O.

When this curve is used for the third segment AB, the following relation holds at $\theta=-\theta_o/2$ corresponding to point A:

$$R_1\left(-\frac{\theta_o}{2}\right) = \frac{L_1}{2} - \frac{R'_1 - R_1}{2} \sin \frac{\pi}{2} = \frac{R_1 + R'_1}{2} - \frac{R'_1 - R_1}{2} = R_1 = \overline{OA}_1$$

The arcuate portions at the opposite ends of the slider 2 have a radius r, so that $\overline{OA}=R_1+r=R$.

It is clear that $\overline{OB}=R_1'=R$ at point B too, so that the curve of the peripheral edge is smooth and has no irregularities.

We have fabricated a compressor having a cylinder chamber of the peripheral edge of the aforesaid curved shape and various experiments were conducted on this compressor. The results of the experiments show that this compressor has the disadvantage that the slider 2 has large fluctuations in acceleration and the force exerted on the slider 2 shows a variation of large magnitude so that the slider 2 wobbles and produces noise during operation.

We have carried our research into this problem and have found that the problem can be obviated when the peripheral edge of the cylinder chamber 33 has the shape of a special curve presently to be described.

The curve of the peripheral edge 3a of the cylinder chamber 33 developed by us will now be described in detail. Of the peripheral edge 3a, the segments DA and BC of the radii R and R' respectively are the same as the corresponding segments of the peripheral edge described hereinabove, so that their description will be omitted.

At the third segment AB of the peripheral edge 3a, the slider 2 extending through the center of rotation O of the rotor 1 moves smoothly in sliding movement radially thereof. Thus the locus $A_1B_1$ traced by the center $O_1'$ of the arcuate portion of one end of the slider 2 is given a shape in curve form that satisfies the relation represented by the following formula in the range $-\theta_o/2 \leqq \theta \leqq \theta_o/2$ and with $\angle A_1OB_1=\theta_o$ and the angle $\theta$ of a straight line E dividing $\angle A_1OB_1$ into two equal parts being $\theta=O$:

$$R_2(\theta) = \frac{L_1}{2} + \frac{R'_1 - R_1}{\theta_o}\left(\theta + \frac{\theta_o}{2\pi} \sin \frac{2\pi\theta}{\theta_o}\right).$$

An external envelope formed by a family of circles of the radius r of the arcuate portion of the one end of the slider 2 having its center $O_1$ on this curve is used as a curve for the third segment AB. The two opposite ends of the slider 2 being maintained in sliding contact with the segment CD at all times, the locus traced by the center $O_2$ of the arcuate portion of the other end of the slider 2 can be uniquely decided with respect to the locus $A_1B_1$ and has a curve expressed by the formula:

$$\frac{L_1}{2} + \frac{R'_1 - R_1}{\theta_o}\left(\theta + \frac{\theta_o}{2\pi}\sin\frac{2\pi\theta}{\theta_o}\right).$$

the curve being located in a position $L_1 - R_2(\theta)$ which is opposite $R_2(\theta)$ with respect to the center of rotation O. An envelope formed by a family of circles of a curve r centered at this curve is used as a curve for the segment CD.

Figure 4:
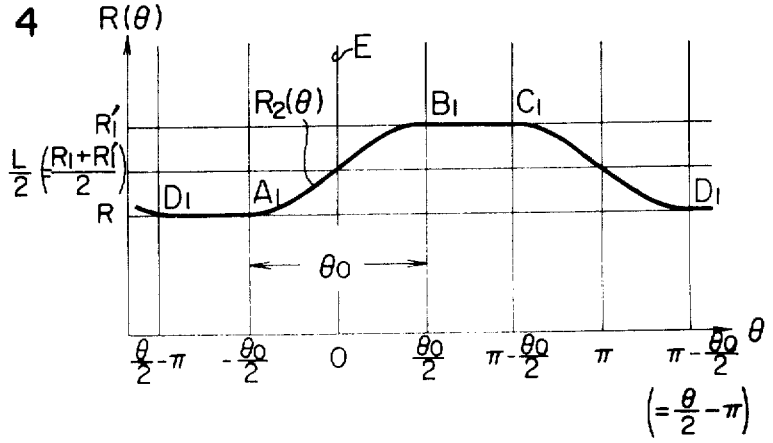
FIG. 4 is a diagrammatic representation of the movement of the slider of the compressor shown in FIG. 1.

The graph shown in FIG. 4 in which the abscissa represents the angle of rotation $\theta$ and the ordinate indicates the distance R ($\theta$) between the center of rotation O of the rotor 1 and the center $O_1$ of the arcuate portion of the one end of the slider 2 indicates the sliding movement of the slider 2 when the peripheral edge 3*a* of the cylinder chamber 33 has this form of curve. It will be seen that the slider 2 is stationary with $R(\theta)=R_1$ in the first segment $D_1A_1$, that the slider 2 smoothly slides in the rotor 1 in the third segment $A_1B_1$, that the slider 2 becomes stationary again in the second segment $B_1C_1$ with $R(\theta)=R'_1$ and that the slider 2 again smoothly slides in the rotor 2 in the third segment $C_1D_1$. It will also be seen that abrupt movement of the slider 2 is avoided at points $A_1$, $B_1$, $C_1$ and $D_1$. Thus points A, B, C and D connected together by an external envelope formed by a family of circles of the radius r of the arcuate portions of the ends of the slider 2 form a smooth curve which is concave at every point.

Figure 5:
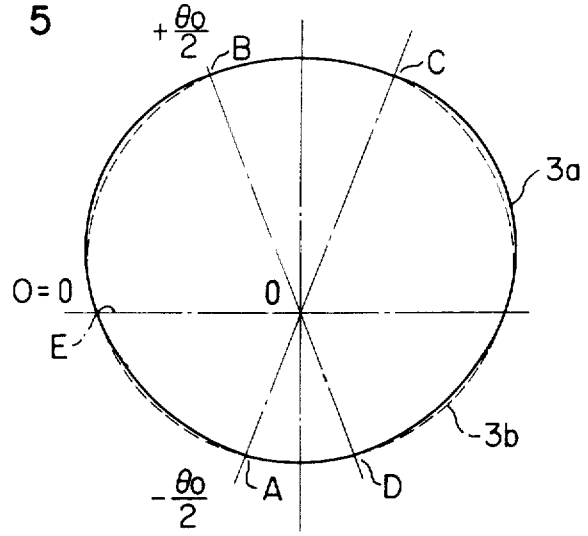
FIG. 5 is a view in explanation of the shape of the peripheral edge of the cylinder chamber of the compressor shown in FIG. 1 in comparison with the shape of a peripheral edge of a sine-wave form.

In FIG. 5, a curve indicated by a solid line 3*a* represents the peripheral edge of the cylinder chamber 33 according to the invention, and a curve indicated by a broken line 3*b* represents the peripheral edge that shows, as described above, changes in the distance between it and the center of rotation O of the rotor 1 in the form of sine-wave. In this figure, the two curves smoothly connect the first and second segments AD and BC together and it appears there is no problem. However, there is actually a great difference between the two curves.

More specifically, acceleration of the sliding movement of the slider 2 is indicated by the following formula without the influence of the centrifugal force:

$$\alpha(\theta) = \frac{d^2R(\theta)}{d\theta^2}\left(\frac{d\theta}{dt}\right)^2, \frac{d\theta}{dt} = \omega, \omega = 2\pi\frac{N}{60}. \ (N\text{: RPM})$$

Thus, with the curve according to the invention of the peripheral edge 3*a*, acceleration of the sliding movement of the slider 2 is as follows:

$$\alpha_2(\theta) = -\frac{2\pi\,\omega^2(R'_1 - R_1)}{\theta_o^2}\sin\frac{2\pi\theta}{\theta_o}.$$

Figure 6:
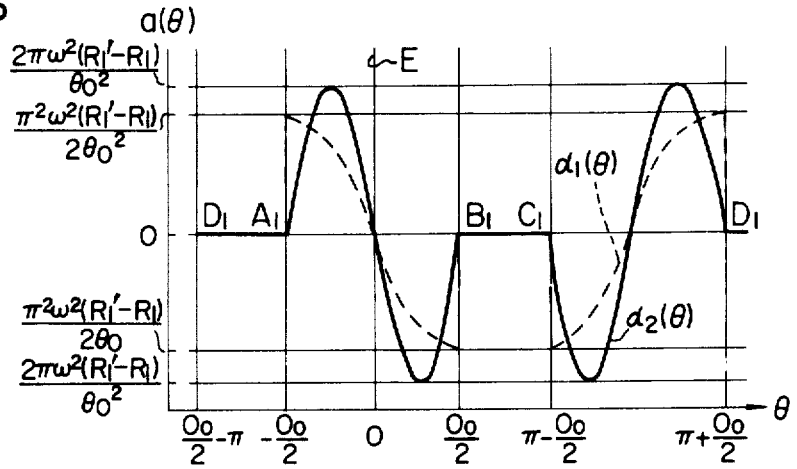
FIG. 6 is a view in explanation of the aceleration of the slider of the compressor shown in FIG. 1 in comparison with the acceleration of the slider of a compressor having a cylinder chamber with a peripheral edge of a sine-wave form.

Accordingly, changes in the acceleration $\alpha_2(\theta)$ with respect of the angle of rotation $\theta$ show a distribution represented by a solid line in FIG. 6 when the curve of the peripheral edge of the cylinder chamber 33 as indidated at 3*a* in FIG. 5 is used. Moreover, owing to the action of the acceleration $\alpha_2(\theta)$ exerted on the slider 2, the load applied between the peripheral edge 3*a* of the housing chamber 33 and the slider 2 has a value which is the acceleration in FIG. 6 multiplied by the mass of the slider 2.

Meanwhile when the peripheral edge of the cylinder chamber 33 has a sine-wave form expressed by the formula $$R_1(\theta) = \frac{L_1}{2} + \frac{R'_1 - R_1}{2}\sin\frac{\pi\theta}{\theta_o},$$

the acceleration is represented by the following formula:

$$\alpha_1(\theta) = -\frac{\omega^2(R'_1 - R)}{2\theta_o^2}\sin\frac{\pi\theta}{\theta_o}.$$

The acceleration $\alpha_1(\theta)$ shows changes with respect to the angle of rotation $\theta$ which are indicated by a broken line in FIG. 6.

In FIG. 6, it will be clearly seen that when the peripheral edge of the cylinder chamber 33 has a sine-wave form, acceleration of the sliding movement of the slider 2 shows sudden increases at point B ($\theta=\theta_o/2$) and point C $$\left(\theta = \pi\frac{\theta_o}{2}\right)$$

at which the first and second segments DA and BC of the arcuate shape and the third segment AB, CD of the sine-wave form are joined together. When the peripheral edge is shaped as indicated at 3*a*, however, no sudden increases in acceleration occurs at points B and C.

This indicate that with the third segment of the sine-wave form, the slider 2 wobbles when the ends of the slider 2 are brought into contact with the first and second segments DA and BC and brought out of contact therewith, so that the slider 2 impinges on the peripheral edge of the cylinder chamber 33 and tends to produce noise at these times. Meanwhile, in the cylinder chamber 33 having the peripheral edge of the shape indicated at 3*a*, the slider 2 moves in good sliding reciprocatory movement in the rotor 1 and the opposite ends of the slider 2 are maintained in smooth sliding contact with the peripheral edge 3*a* of the cylinder chamber 33 at all times, so that the movement of the slider 2 generates almost no noise.

Moreover, in the compressor according to the invention, the slider 2 is arcuate in shape at its opposite ends, so that the point at which the ends of the slider 2 are maintained in contact with the peripheral edge of the cylinder chamber 33 always varies from one position to another, so that no uneven wear is caused on the opposite ends of the slider 2.

Figure 7:
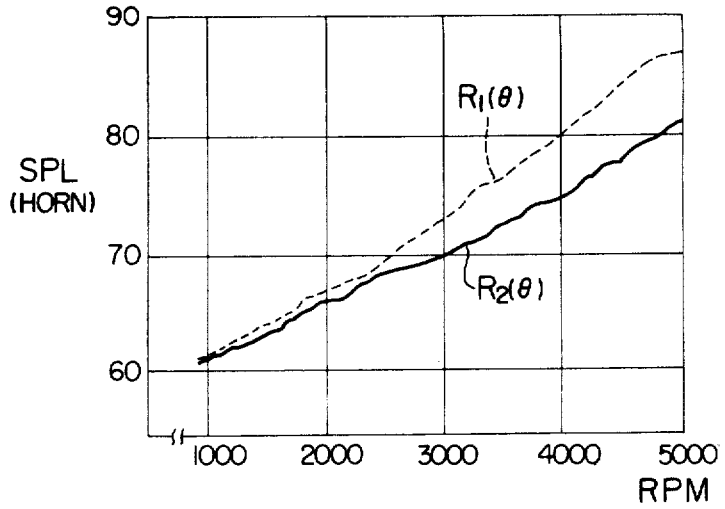
FIG. 7 is a view in explanation of the effects achieved by the two compressors described by referring to FIG. 6 in reducing noise.

FIG. 7 shows the results of experiments conduced on the compressor according to the invention to test its performance. In FIG. 7 that shows a diagram in which the abscissa represents the RPM and the ordinate indicates the noise level, performance of the compressor according to the invention having a rotary slider adapted to engage the peripheral edge of the cylinder chamber of the novel curve indicated at 3*a* is shown in comparison with that of a compressor having a rotary slider adapted to engage the peripheral edge of the cylinder chamber that has the distance between it and the rotor varied in sine-wave form as described hereinabove. It will be evident in FIG. 7 that the rotary compressor according to the invention represented by a solid line produces far less noise than the rotary compressor of the prior art shown in broken line, during high speed operation of the rotary compressor.

What is claimed is:

1. A through-vane type rotary compressor comprising:

housing means having a cylinder chamber therein;

a fluid inlet port and a fluid outlet port opening in said cylinder chamber;

a cylinder rotor eccentrically supported in said cylinder chamber; and a slider slidably extending through the center of rotation of said rotor having opposite ends maintained in sliding contact with a peripheral edge of said cylinder chamber;

wherein the improvement resides in that:

the peripheral edge of said cylinder chamber is shaped such that it includes a first segment of a predetermined angle interposed between said fluid inlet port and said fluid outlet port, said first segment being circularly arcuate in shape with a radius R where R is the radius of the rotor, a second segment disposed symmetrically with said first segment with respect to the center of rotation of the rotor, said second segment being circularly arcuate in shape with a radius $R'=L-R$ where L is the length of the slider, and a third segment connecting said first segment and said second segment together, said third segment having a shape represented by the formula:

$$R_2(\theta) = \frac{L}{2} + \frac{R' - R}{\theta_o}\left(\theta + \frac{\theta_o}{2\pi}\sin\frac{2\pi\theta}{\theta_o}\right)$$

where $\theta_o$ in the angle of a segment having the third segment as an arc.

2. A through-vane type rotary compressor as claimed in claim 1, wherein the slider maintained in sliding contact with the peripheral edge of the shape described in claim 1 in the cylinder chamber undergoes acceleration showing smooth changes.

3. A through-vane type rotary compressor as claimed in claim 1 or 2, wherein the opposite ends of said slider are each shaped in an arcuate form.

* * * * *